US012660908B2

(12) United States Patent
Lewis

(10) Patent No.: US 12,660,908 B2
(45) Date of Patent: Jun. 23, 2026

(54) LEG-MOUNTED MEDIA DISPLAY DEVICE

(71) Applicant: Breazid Lewis, Eureka, CA (US)

(72) Inventor: Breazid Lewis, Eureka, CA (US)

( * ) Notice: Subject to any disclaimer, the term of this patent is extended or adjusted under 35 U.S.C. 154(b) by 37 days.

(21) Appl. No.: 18/828,882

(22) Filed: Sep. 9, 2024

(65) Prior Publication Data

US 2025/0082090 A1 Mar. 13, 2025

Related U.S. Application Data

(60) Provisional application No. 63/537,856, filed on Sep. 12, 2023.

(51) Int. Cl.
*A45F 5/00* (2006.01)
*A47B 23/00* (2006.01)

(52) U.S. Cl.
CPC ..... *A45F 5/00* (2013.01); *A47B 23/004* (2013.01); *A45F 2005/008* (2013.01); *A45F 5/1516* (2025.01)

(58) Field of Classification Search
CPC .... A45F 5/00; A45F 5/1516; A45F 2005/008; A47B 23/004
See application file for complete search history.

(56) References Cited

U.S. PATENT DOCUMENTS

| | | | | |
|---|---|---|---|---|
| 4,103,809 | A * | 8/1978 | Frost | A45F 5/00 235/61 NV |
| 4,243,249 | A * | 1/1981 | Goss | B42F 9/001 281/43 |
| 7,969,732 | B1 * | 6/2011 | Noble | F16M 11/10 361/679.55 |
| 10,117,512 | B1 * | 11/2018 | Moore | G10G 7/00 |
| D865,752 | S * | 11/2019 | Richardson | D14/447 |
| 2020/0359774 | A1 * | 11/2020 | Caine | F16M 13/022 |

* cited by examiner

*Primary Examiner* — Amy J. Sterling
(74) *Attorney, Agent, or Firm* — Larisa Migachyov

(57) ABSTRACT

A portable media holder is described, comprising a base, a strap configured to attach the base to a user's limb, and a media holder integrated into the top side of the base that is configured to hold at least one sheet of paper at an angle ranging between vertical and 45° off vertical and to flex it in such a way that it stays stiff while in the media holder.

13 Claims, 13 Drawing Sheets

LEG-MOUNTED MEDIA DISPLAY DEVICE

CROSS-REFERENCE TO RELATED APPLICATIONS

The present application takes priority from Provisional App. No. 63/537,856, filed Sep. 12, 2023, which is incorporated herein by reference.

BACKGROUND

Field of the Invention

The present invention relates generally to devices for displaying communications, and more particularly to portable music stands.

Background of the Invention

There has been a large variety of music stands in use throughout the history of written music. Most of them are bulky and hard to transport, comprising a tray at the top to hold paper sheets or books and a stand at the bottom to keep the device upright. While folding music stands do exist, they are flimsy, susceptible to breakage, and often hard to assemble and deploy.

Another problem associated with traditional music stands is that they take up significant space near the user, often blocking the line of sight between the user and other parties.

Finally, a traditional music stand is hard to use outdoors, especially on uneven ground, and is vulnerable to falling over when it is windy.

A need exists for a portable music stand that can be used outdoors, does not require significant space near the user or block line of sight, and is easy to assemble and use.

SUMMARY OF THE INVENTION

An object of the present invention is to provide a portable media display stand that can be used outdoors, does not require significant space near the user, does not block lines of sight, and can still function when it is windy.

Another object of the present invention is to provide a portable media display stand that can attach to a user's limb.

The device of the present invention comprises a strap with buckles on either end, a base that attaches to the strap, and a media holder integrated into the top side of the base. The media holder can hold at least one sheet of paper at an angle ranging from vertical to 45° off vertical.

The strap may be approximately equal to the circumference of a typical human thigh, and the media holder can be configured so that a seated user can read the media on a sheet of paper in the media holder when the device is attached around the user's thigh. The strap may be elastic.

The media holder may be a curved slot cut in the top side of the base. The slot may be wide or narrow. The wide curved slot may have a rectangular cross-section approximately 15 mm wide, and may be curved with a radius of approximately 58 mm. The narrow curved slot may have a triangular cross-section with one vertex at the bottom, and the width of approximately ½" at the top. The radius of the narrow curved slot may be approximately 75 mm.

In an embodiment, the media holder may comprise both a narrow and a wide curved slot.

In an embodiment, the media holder also comprises a phone holder, wherein the phone holder comprises a cutout for a charger cord.

In an embodiment, the device also comprises separate attachments that can fit into the wide curved slot. In an embodiment, a separate phone holder attachment is used, comprising a clamp for holding a mobile phone and a curved plug that fits into the wide curved slot.

In an embodiment, the device also comprises a separate music stand attachment, with a wide platform for supporting sheetmusic, wherein the separate music stand attachment also comprises a curved plug that fits into the wide curved slot.

LIST OF FIGURES

DETAILED DESCRIPTION OF THE PREFERRED EMBODIMENT

While the foregoing disclosure describes the device of the present invention being used to hold sheetmusic while playing a musical instrument or singing, it is to be understood that it is not limited to that application. The device of the present invention may be used to hold any flexible media in a vertical position while a user is seated.

In brief, the device of the present invention is a media holder that attaches to a user's limb (arm or leg) while a user is seated and holds it in such a position that the user can see the media while seated. The embodiment described below is a sheetmusic holder that attaches to a user's limb while the user is playing a musical instrument and holds sheetmusic in the correct position for the user to see it while playing. This enables a user to see their sheetmusic even in places where a regular music stand is not practicable. For example, in an outdoor music festival, the ground may be uneven, it may be windy, and it may be too hard to lug around both a musical instrument and a bulky music stand. In a crowded orchestra or band, a regular music stand may block a user's line of sight and may require too much space in front of the user. In both of those applications, a leg-mounted music holder will be preferable—it takes no extra space in front of the user, it does not block the user's line of sight, and it can be used even on uneven ground or in windy conditions.

In its most basic form, the device comprises three elements—a strap, a base that is attached to the strap, and a media holder integrated into the top side of the base. The strap is configured to buckle around a user's limb, such as an arm or a leg. The media holder is configured to hold the media in such a way that the user can easily see it. The base attaches to the strap (removably or non-removably) and is rigidly attached to the media holder.

Figure 1A:
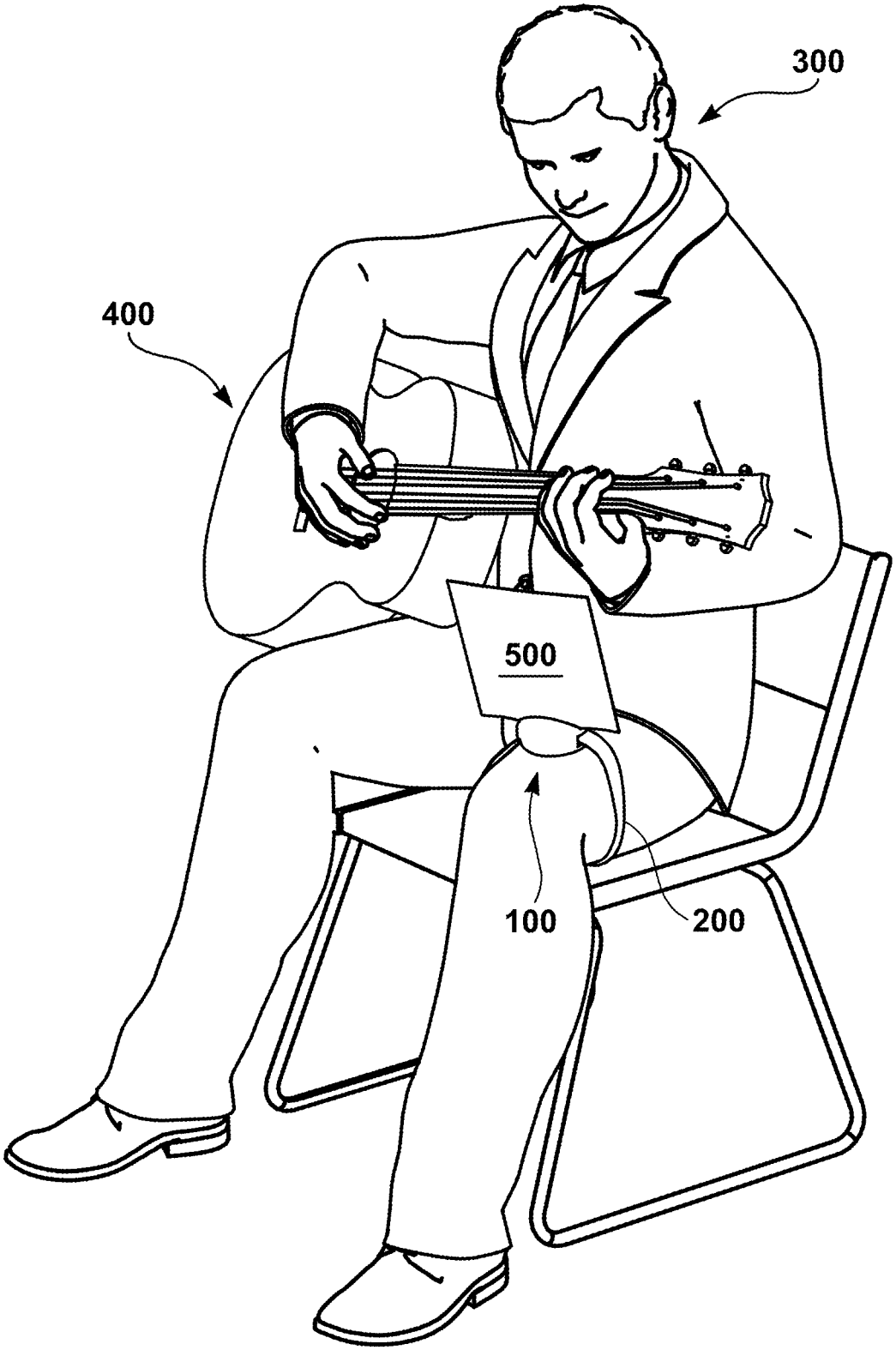
FIG. 1A is an illustration of an embodiment of the present invention in use.
Figure 1B:
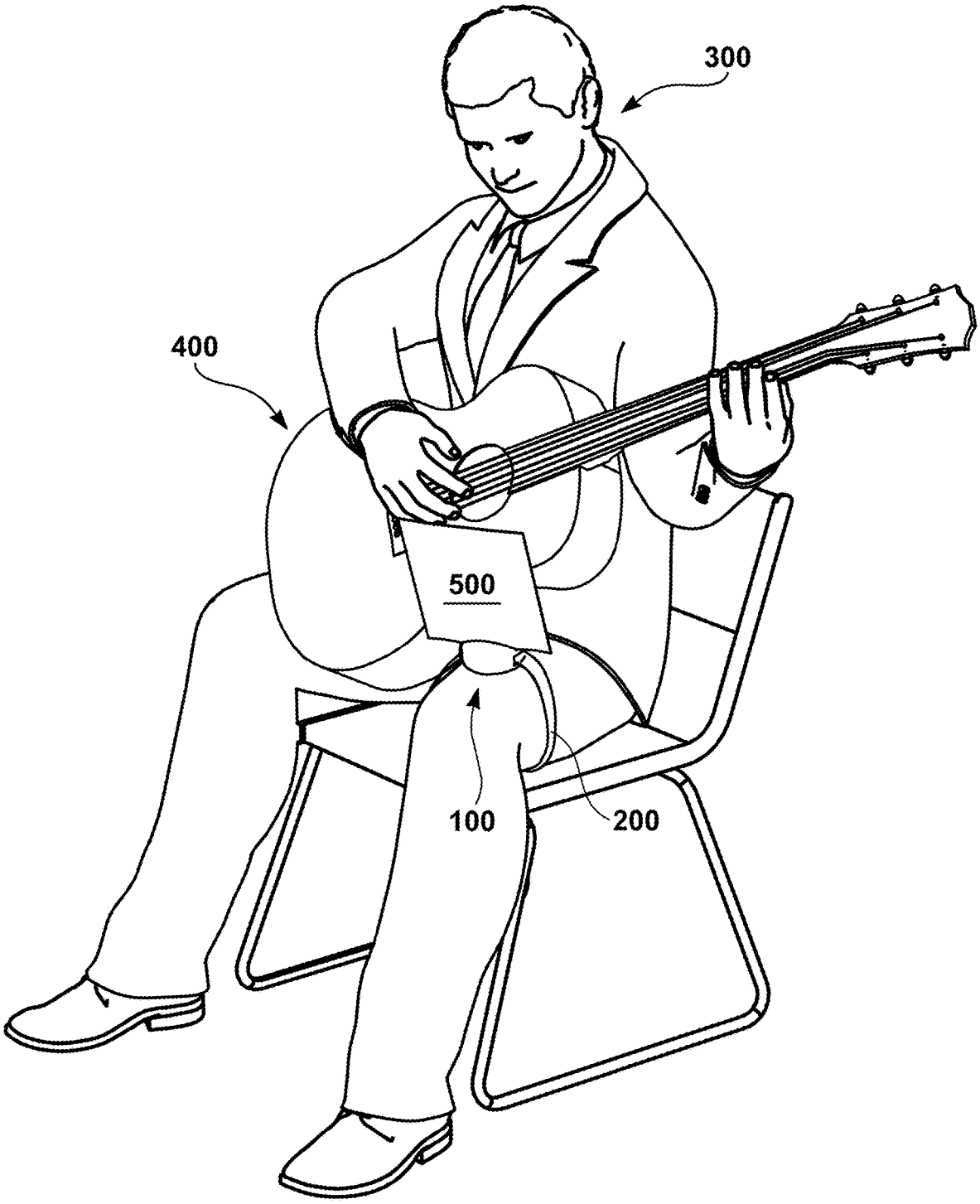
FIG. 1B is an illustration of an embodiment of the present invention in use.

FIGS. 1A and 1B show a diagram of an embodiment of the device of the present invention. The leg-mounted media display device base 100 is attached with a strap 200 around a user's leg while the user 300 is playing a guitar 400. The device holds a music book 500 at an appropriate angle for the user to read while playing. As can be seen in the two Figures, the device can be usable for a classical guitar (shown in FIG. 1B) or an acoustic guitar (shown in FIG. 1A).

Figure 2:
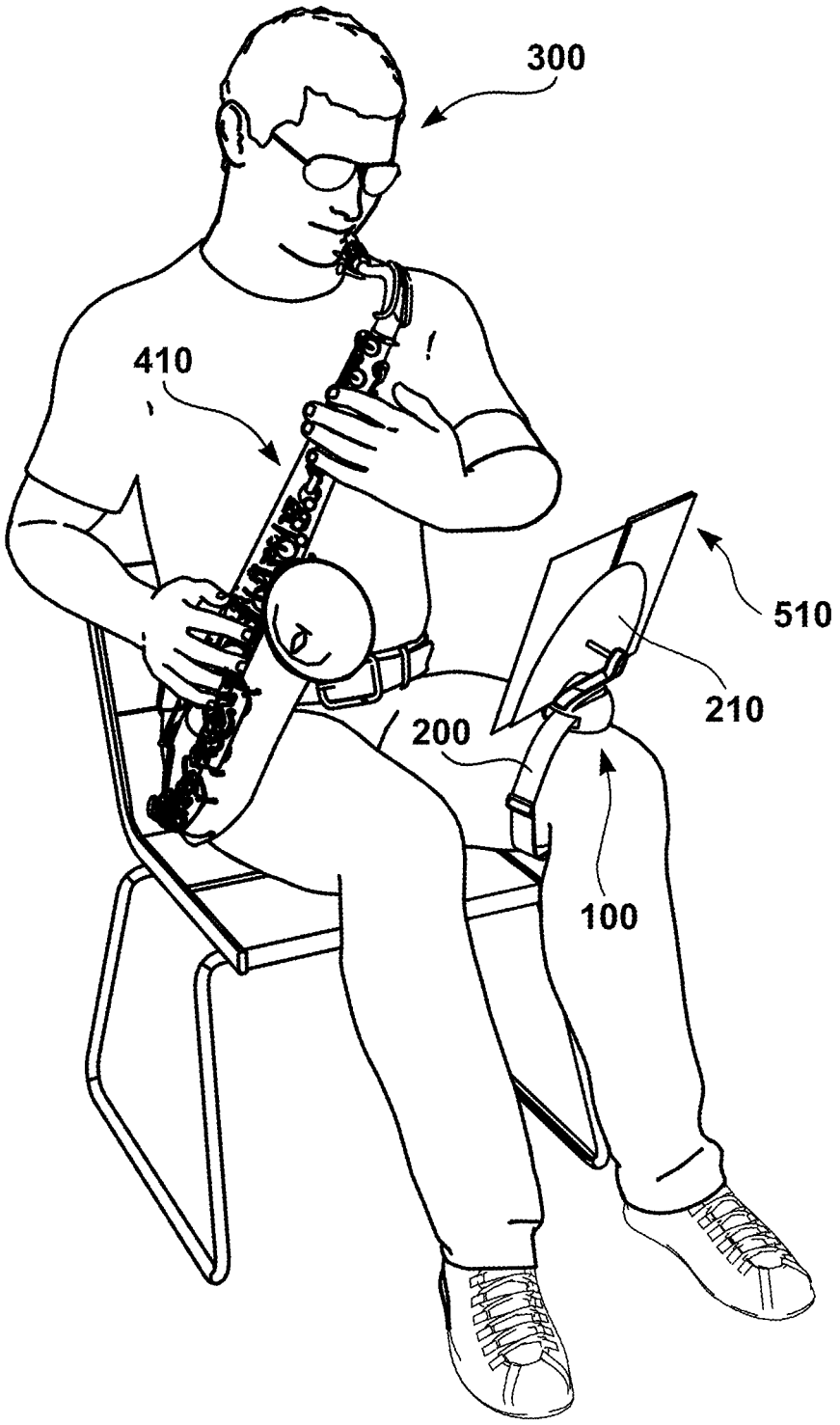
FIG. 2 is an illustration of an embodiment of the present invention in use.

The device of the present invention may also be used for other instruments, as long as they can be played while seated. As shown in FIG. 2, a user can play the saxophone 410 while using the device. The disclosure is not meant to be limiting to any type of musical instrument (or for that matter, any other activity where a user may need to refer to a sheet of paper or a book that needs to be held at a particular angle.)

As shown in FIG. 2, the leg-mounted media display device 100 can incorporate attachments—for example, a music stand 210 that can hold a single page 510 of music. The attachments may also be used to hold a mobile phone or tablet, as discussed below.

Figure 3:
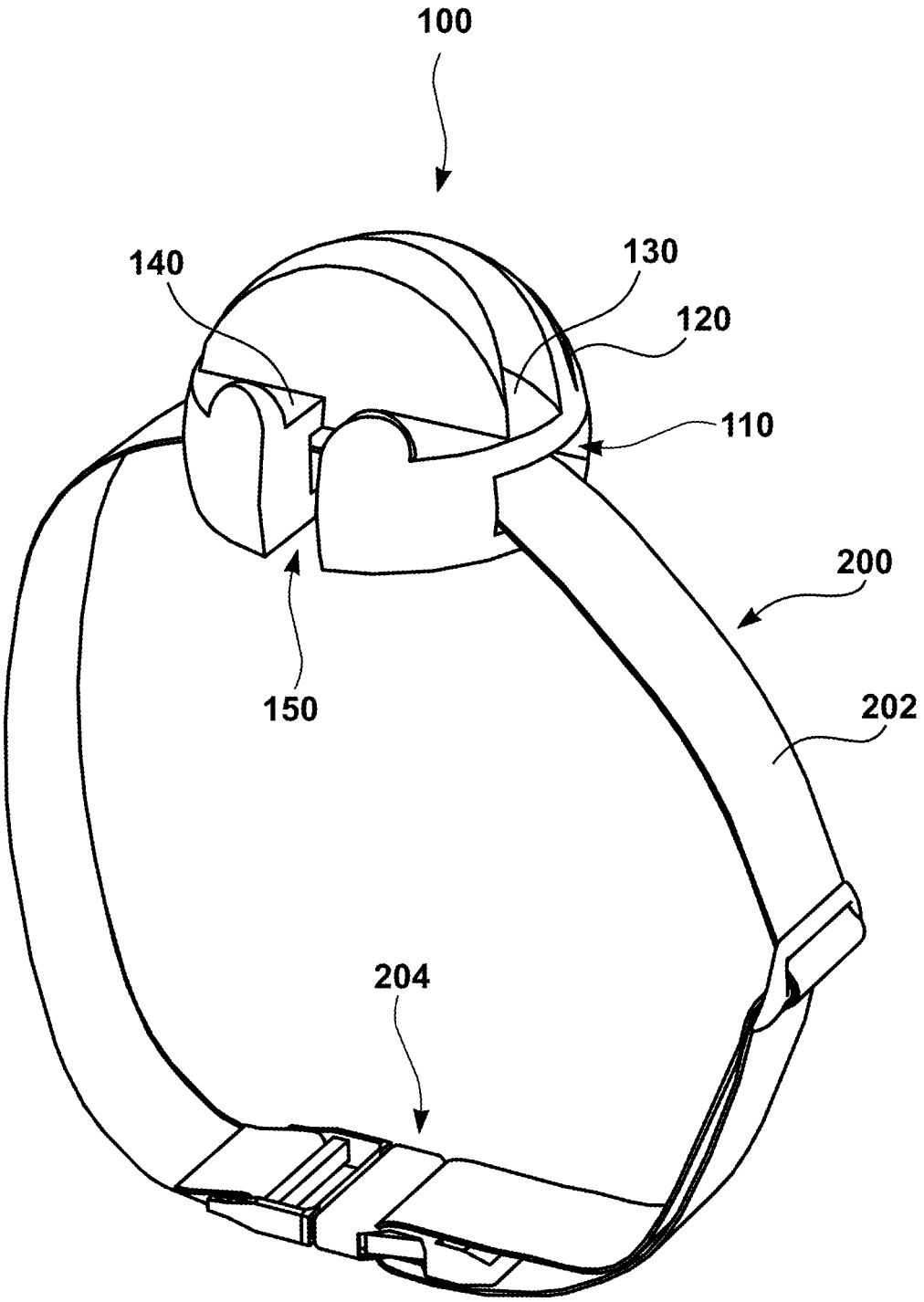
FIG. 3 is an illustration of an embodiment of the present invention.

FIG. 3 shows a close-up diagram of an embodiment of the leg-mounted media display device. As shown, it comprises a base 100 and a strap 200; the base is a rigid piece of material that comprises a strap hole 110 through which strap 200 is inserted. Strap 200 is preferably (but not necessarily) made of elastic webbing 202, and of an approximate size to fit around a typical user's thigh. In an embodiment, it comprises a buckle 204 to make it easier to attach and detach, and it is adjustable in length to fit different sizes of users. While the strap is elastic in its preferred embodiment, a non-elastic strap made of webbing may also be used.

Base 100 comprises one or more types of media holders incorporated into its top side, configured in such a way that they hold a piece of readable media at an appropriate angle for reading while seated. In the embodiment shown in FIG. 3, the base comprises three separate media holders—a phone or tablet holder 140 with a cutout 150 for the charging cable, a wide curved slot 130, and a narrow curved slot 120. Those features will be discussed further below.

While the embodiments described below incorporate three types of media holders, it is to be understood that the base may incorporate only one or two of the media holders described below. The present invention does not require all three media holders to be present.

Figure 4A:
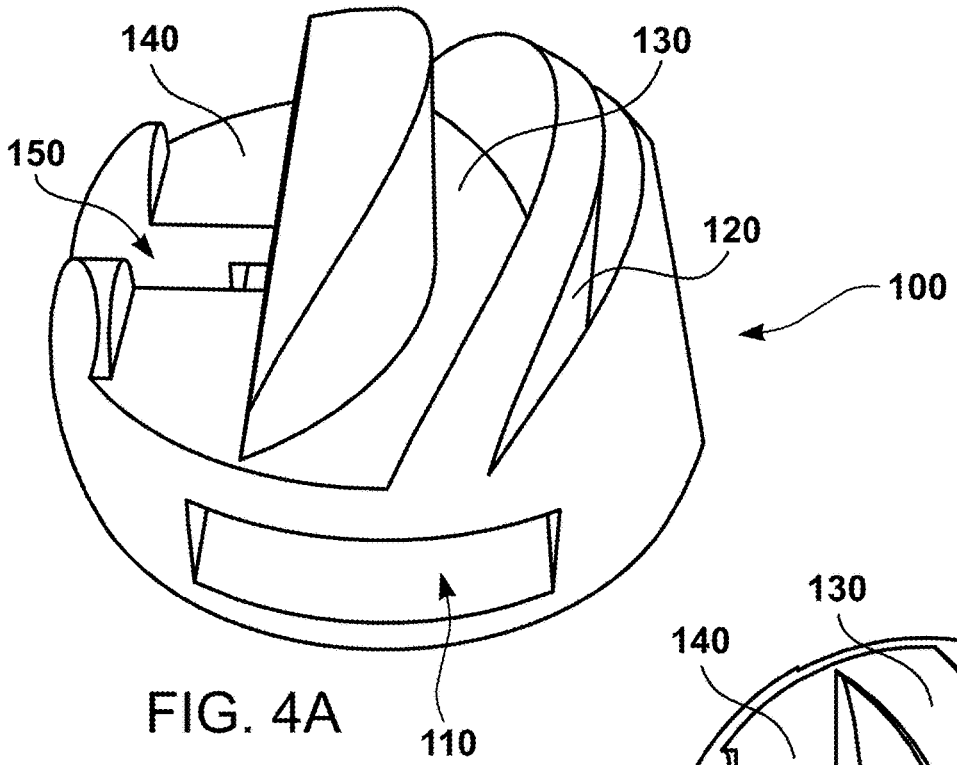
FIG. 4A is an illustration of the base of an embodiment of the present invention.
Figure 4B:
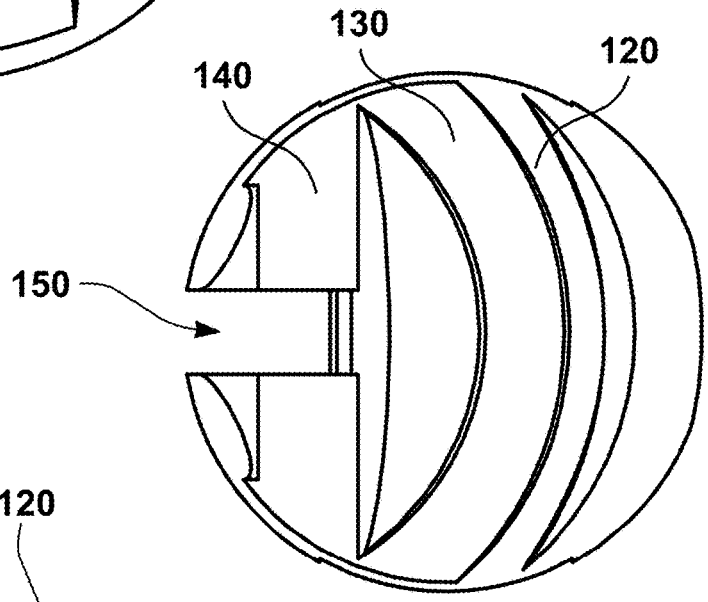
FIG. 4B is an illustration of the base of an embodiment of the present invention.
Figure 4C:
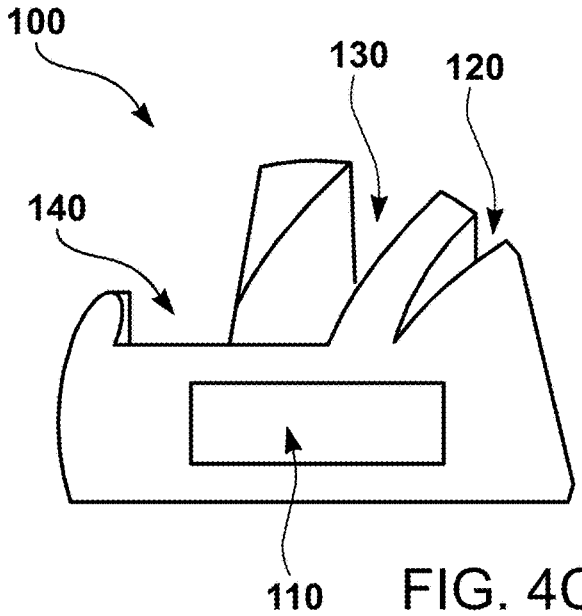
FIG. 4C is an illustration of the base of an embodiment of the present invention.

FIGS. 4A, 4B, and 4C show three separate views of the embodiment of the base portrayed in FIG. 3. As shown, the wide curved slot 130 and the narrow curved slot 120 are configured in such a way as to hold paper-based media in a position that will prevent the paper from flexing forward—the radius of the curved slots is such that the paper-based media stays stiff and does not flex. The wide curved slot 130 is intended for music books or other multi-page media; the narrow curved slot 120 is intended for a single sheet of paper.

As shown in FIG. 4C, the wide curved slot 130 has a rectangular cross-section; the narrow curved slot has a triangular cross-section to improve retention of the single sheet of paper. In the embodiment shown in the Figure, the radius of the wide curved slot is approximately 58 mm; the radius of the narrow curved slot is approximately 75 mm. The width of the wide curved slot is approximately 15 mm; the narrow curved slot is approximately 8 mm wide at the top and narrows down to a point. While these dimensions provide the requisite function of keeping a sheet of paper or a bound soft-cover booklet vertical and keeping it from flexing, it is to be understood that any other radius and width of the curved slots is also included in the present invention, as long as the curved slots have sufficient curvature to keep the paper-based medium from flexing while inserted into the slots.

As shown in FIGS. 4A-4C, the phone holder 140 comprises a flat surface with a lip to keep the phone (or tablet) at a proper angle for reading, and a cutout 150 for the charging cable.

Strap slot 110 is used to pass the strap 200 through so that the base 100 can easily be fastened to the user's leg. The strap slot 110 is preferably large enough that the buckle 204 fits through it.

In an embodiment, the base 100 also comprises a flat bottom so that it may also be used on a flat surface such as a table.

It is to be understood that while the base 100 shown in the Figures is circular, it does not have to be; there are no restrictions on its shape other than the ones disclosed with relation to the media holder. The base may be square, rectangular, or any other shape. The size of the base is preferably such that it can be easily transported, for example in an instrument case.

In an embodiment, the base 100 is made out of a single piece of plastic. The plastic may be any material that is rigid and capable of holding its shape well enough to support the media it is meant to support. The base may be hollow or solid.

In an embodiment, the base may be modular and some of the media holder features may be removable or replaceable. In that embodiment, the media holder features are rigidly attached to the base.

Figure 5A:
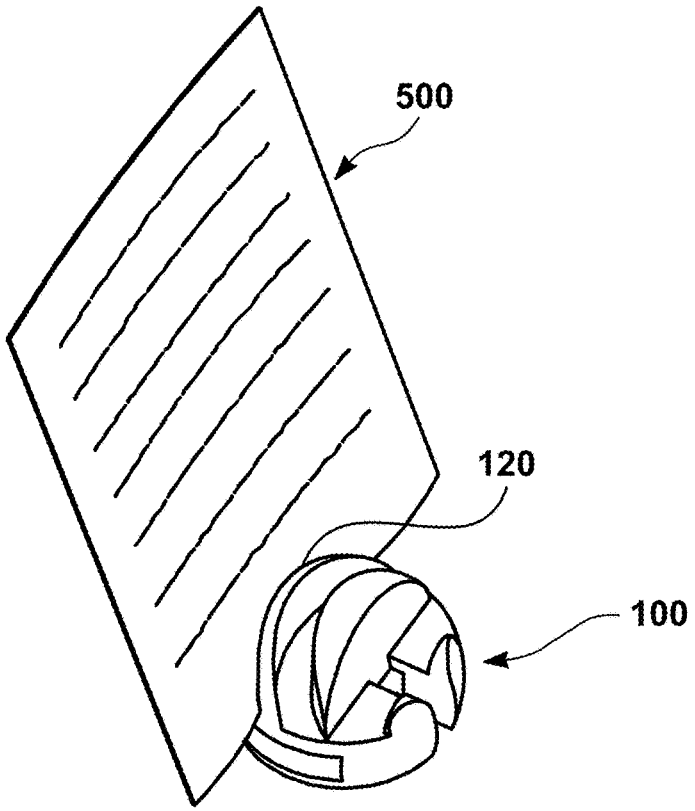
FIG. 5A is an illustration of the use of the narrow curved slot in an embodiment of the present invention.
Figure 5B:
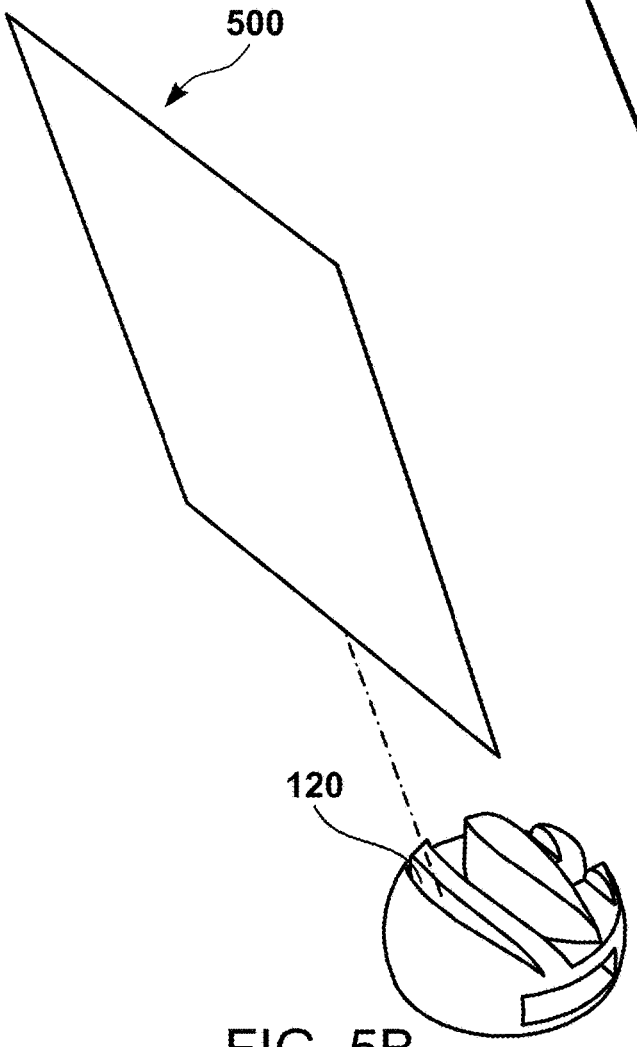
FIG. 5B is an illustration of the use of the narrow curved slot in an embodiment of the present invention.
Figure 5C:
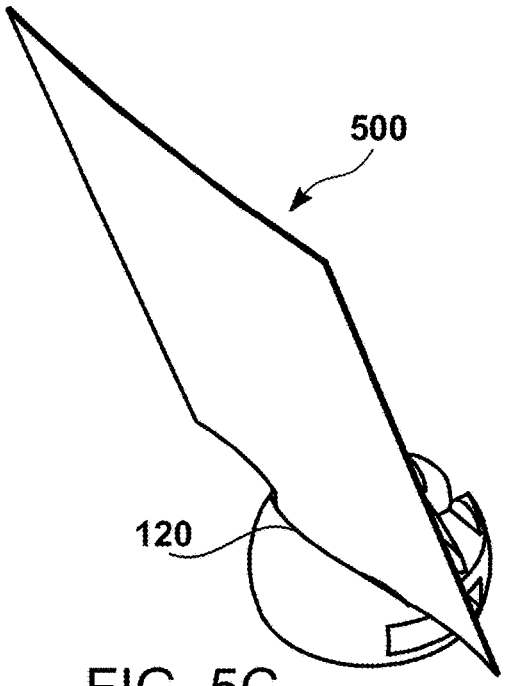
FIG. 5C is an illustration of the use of the narrow curved slot in an embodiment of the present invention.

FIGS. 5A-5C show the base 100 being used to hold a single sheet of paper 500 in the narrow curved slot 120. As shown, the sheet of paper 500 is flexed in such a way as to stay stiff without flexing while it is in the narrow curved slot 120. The bottom of the narrow curved slot 120 preferably narrows down to a point so that the sheet of paper 500 is wedged into it.

Figure 6A:
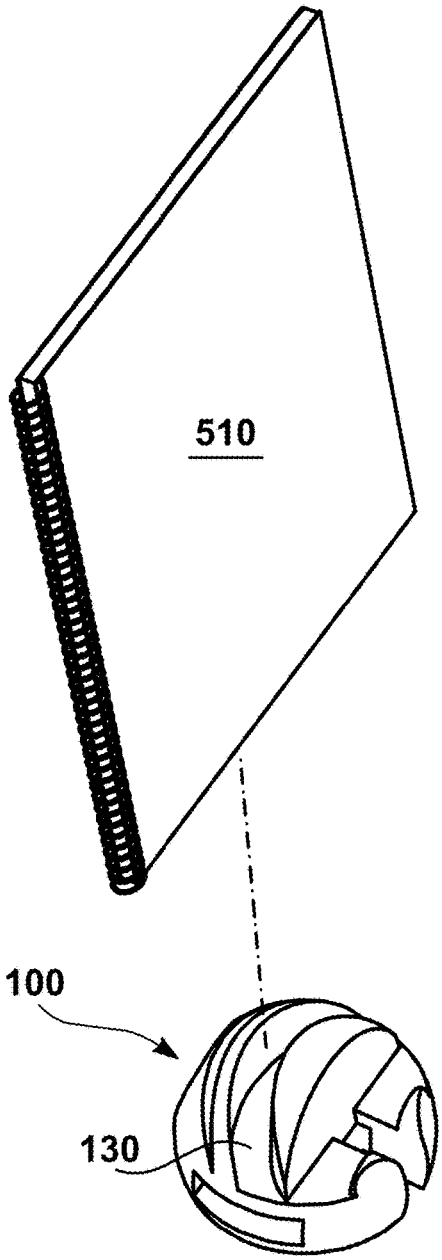
FIG. 6A is an illustration of the use of the wide curved slot in an embodiment of the present invention.
Figure 6B:
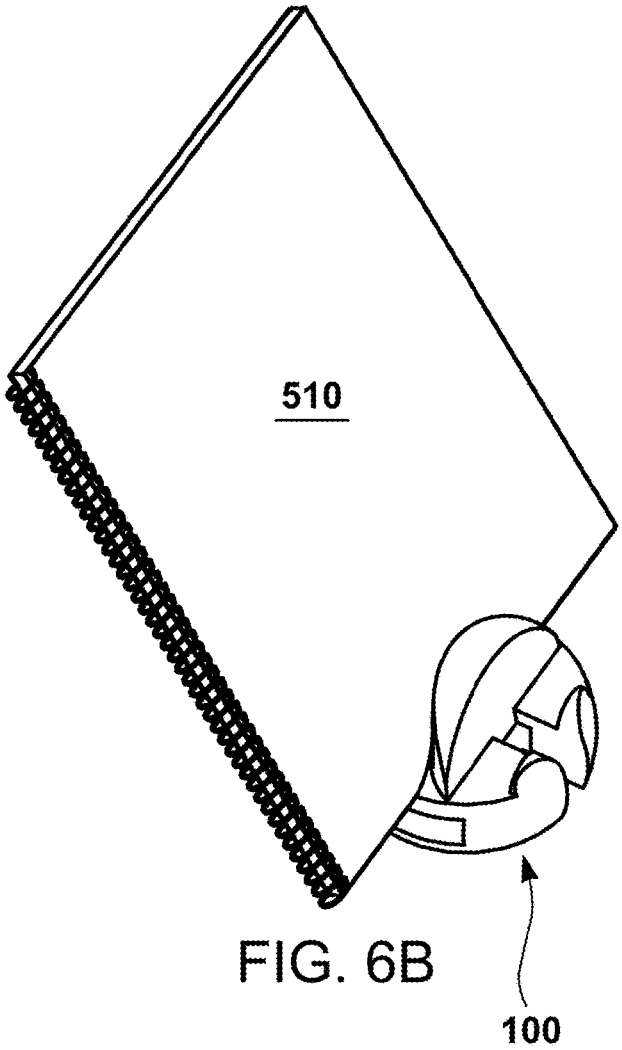
FIG. 6B is an illustration of the use of the wide curved slot in an embodiment of the present invention.

FIGS. 6A-6B show the base 100 being used to hold a softcover book 510 in the wide curved slot 130. As shown, the softcover book 510 is flexed in such a way as to stay stiff without flexing while it is in the wide curved slot 130. The bottom of the wide curved slot 130 is preferably flat to accommodate different thicknesses of books.

Figure 7A:
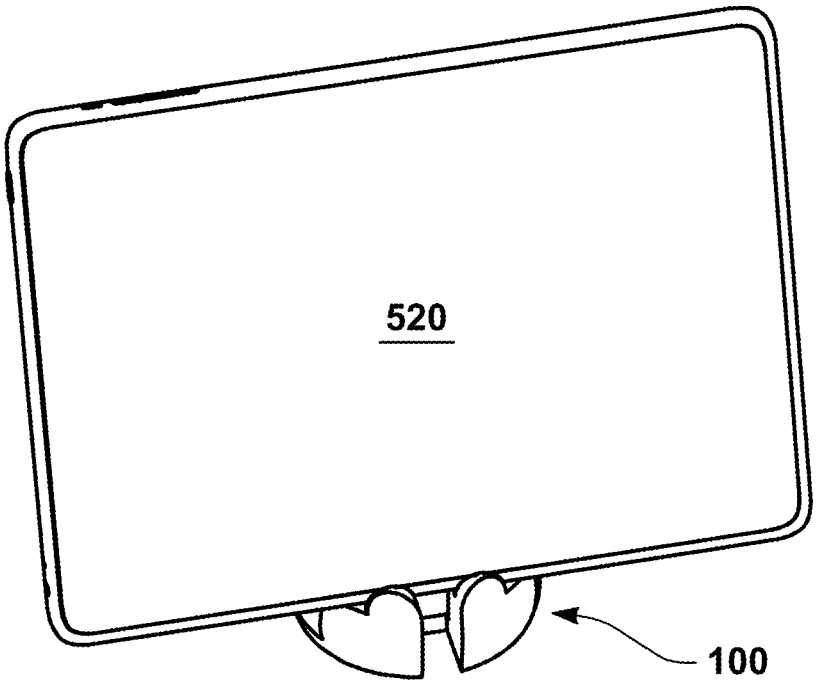
FIG. 7A is an illustration of the use of the electronic device holder in an embodiment of the present invention.
Figure 7B:
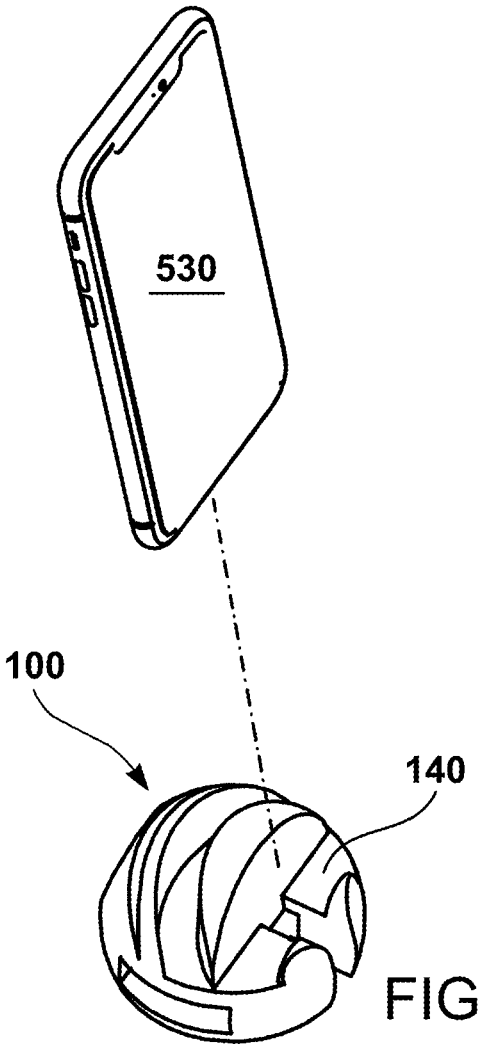
FIG. 7B is an illustration of the use of the electronic device holder in an embodiment of the present invention.
Figure 7C:
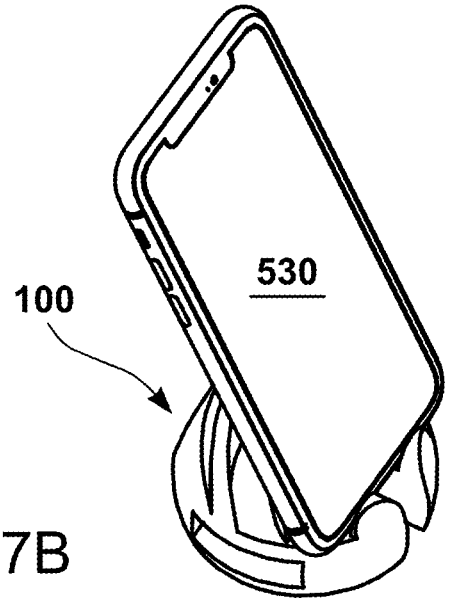
FIG. 7C is an illustration of the use of the electronic device holder in an embodiment of the present invention.

FIGS. 7A-7C show the base 100 being used to hold a mobile phone 530 or a tablet 520 in the phone slot 140.

Figure 8:
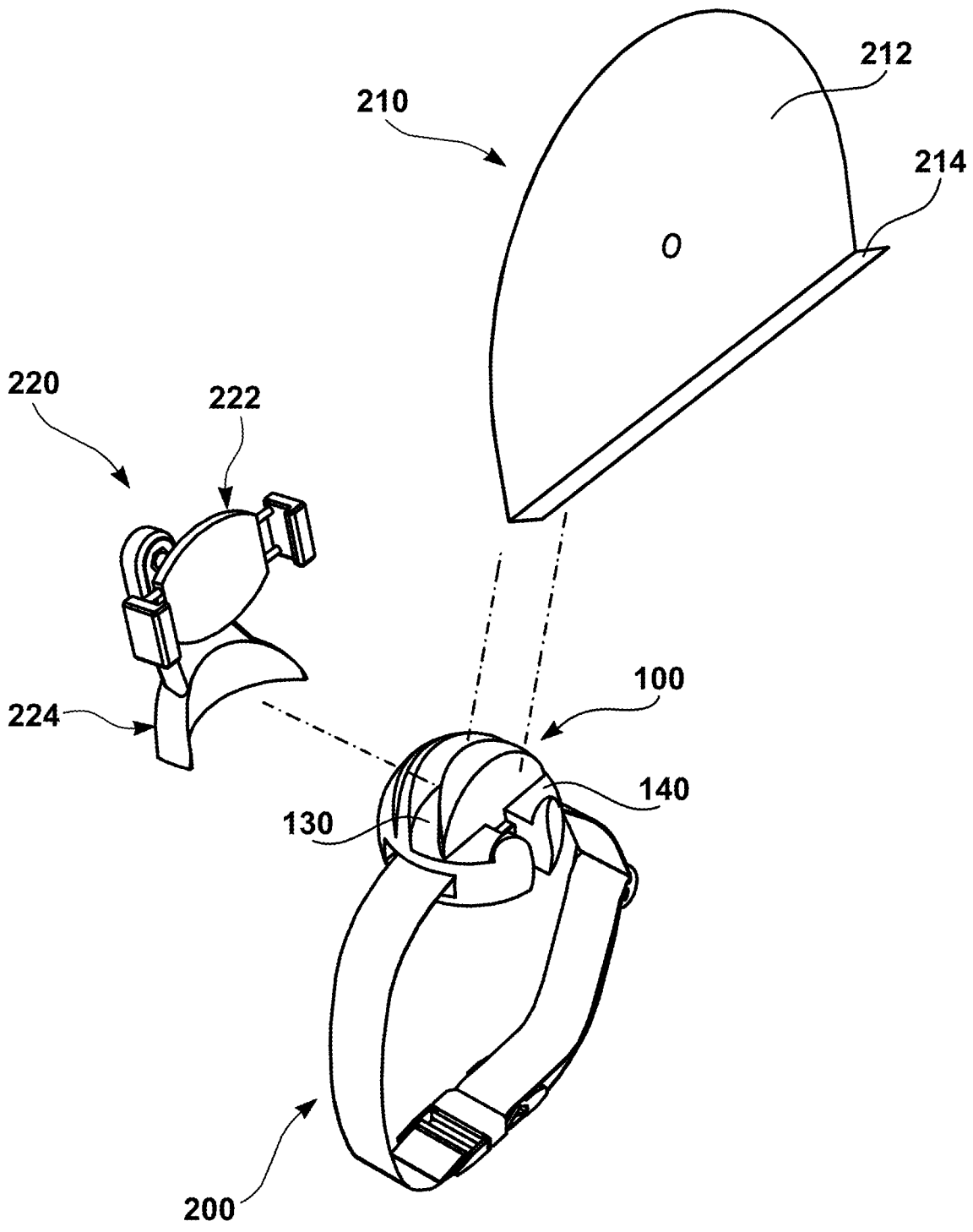
FIG. 8 is an illustration of the use of the attachments in an embodiment of the present invention.

While the base 100 may be used by itself as shown above, various attachments may be used to anchor other devices to the user's leg. FIG. 8 shows two such attachments-a phone holder 220 and a music stand 210. Any attachment attaches to the base with a curved plug 224 that fits the exact contours of the wide curved slot in such a way as to hold the attachment securely. While several attachments are shown in the Figure, any other attachment may also be used with the present invention as long as it comprises a curved plug.

Separate phone holder 220 is used for applications where a user may need to use their phone in a leg-mounted setting and hold it more securely than the phone holder on the base. The separate phone holder 220 comprises a curved plug 224 and a phone clamp 222 that can hold a phone or a tablet.

Figure 9A:
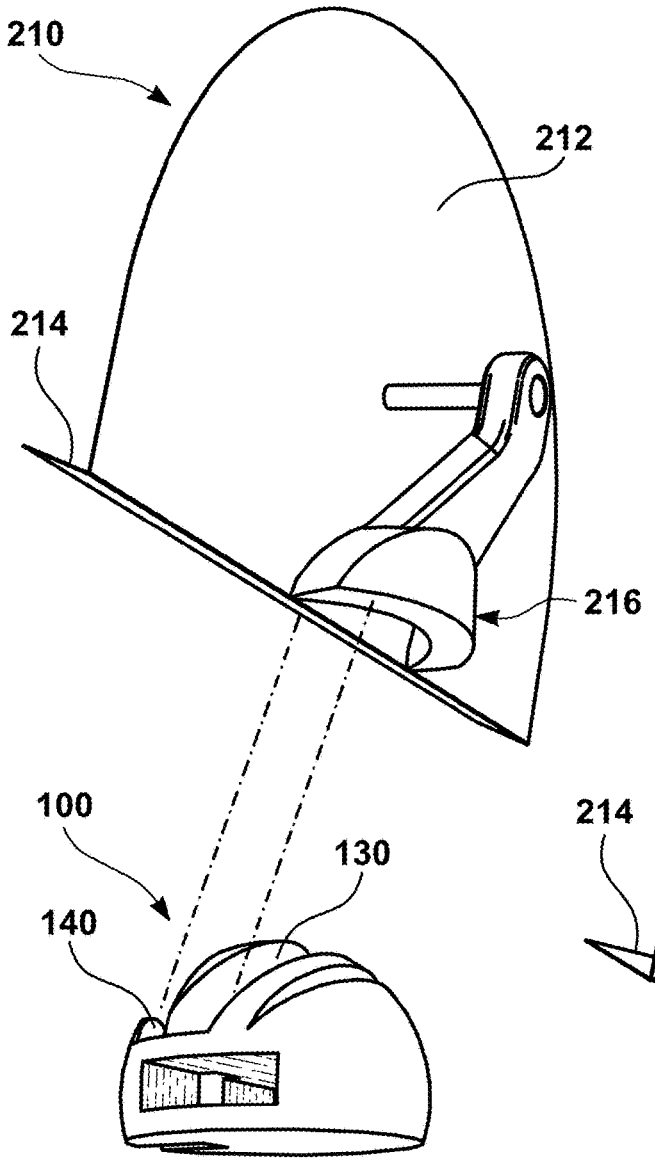
FIG. 9A is an illustration of the use of the music stand attachment in an embodiment of the present invention.
Figure 9B:
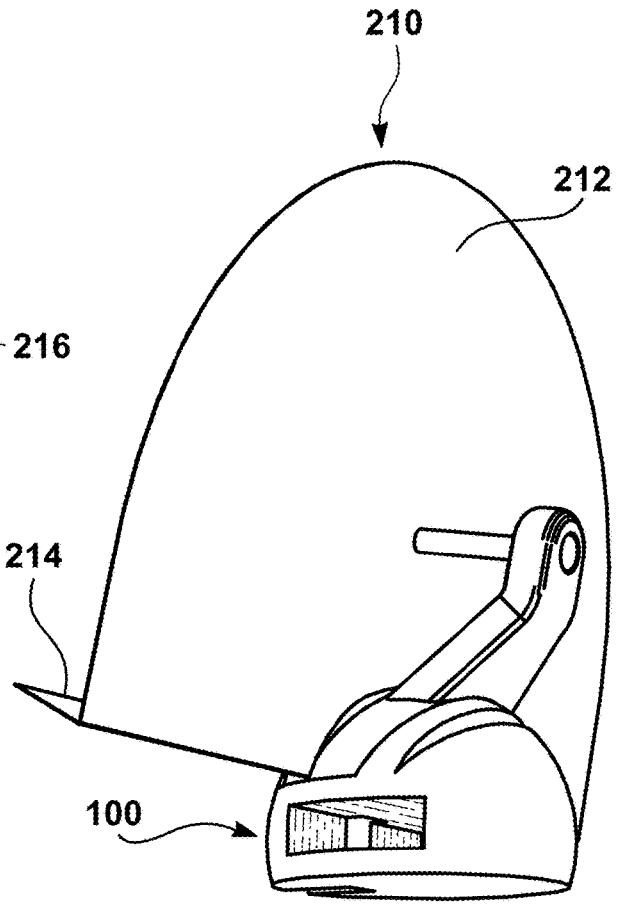
FIG. 9B is an illustration of the use of the music stand attachment in an embodiment of the present invention.
Figure 9C:
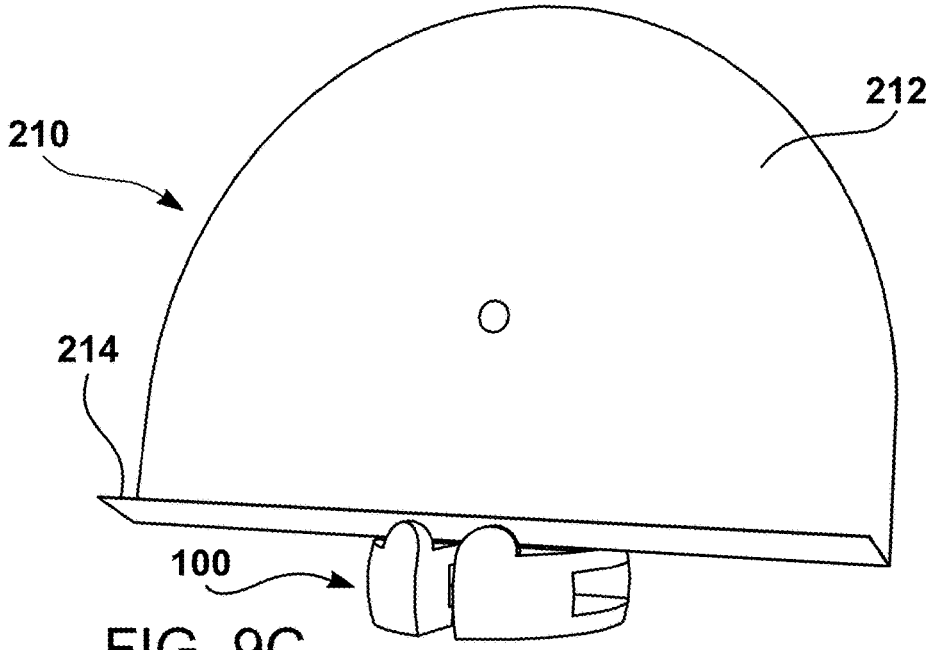
FIG. 9C is an illustration of the use of the music stand attachment in an embodiment of the present invention.
Figure 9D:
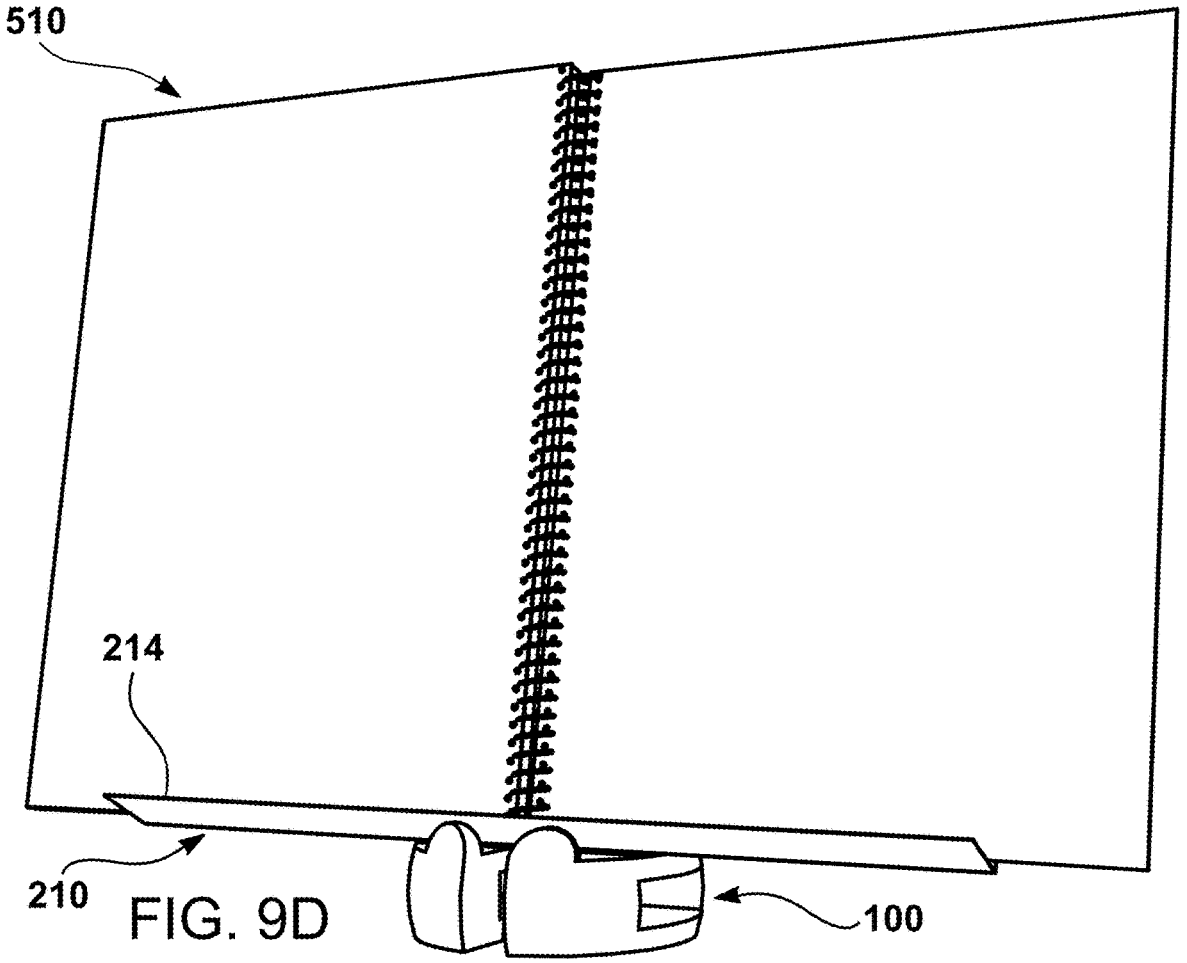
FIG. 9D is an illustration of the use of the music stand attachment in an embodiment of the present invention.
Figure 10A:
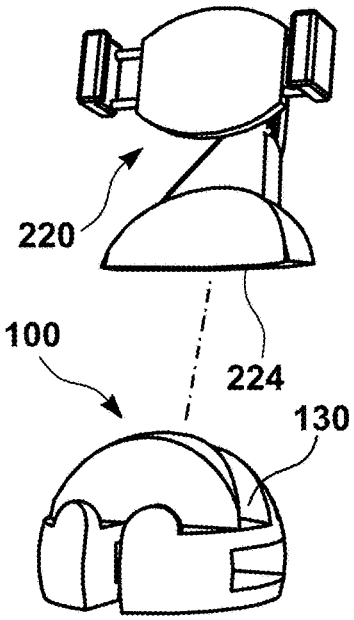
FIG. 10A is an illustration of the use of the mobile phone holder attachment in an embodiment of the present invention.
Figure 10B:
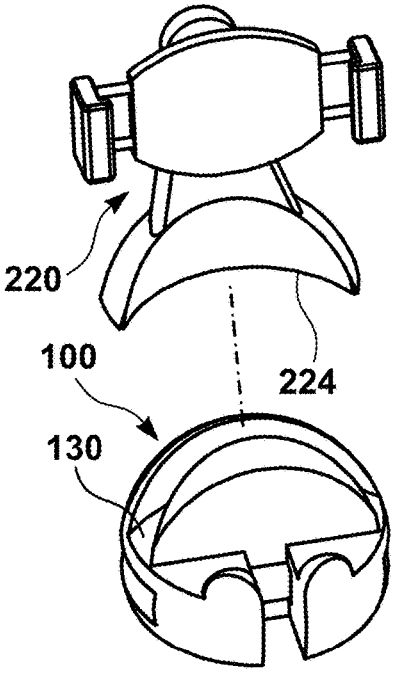
FIG. 10B is an illustration of the use of the mobile phone holder attachment in an embodiment of the present invention.
Figure 10C:
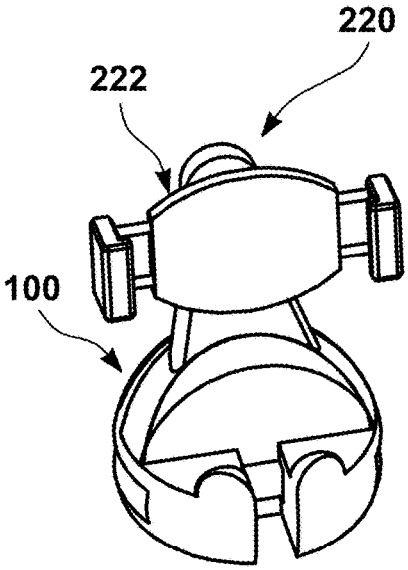
FIG. 10C is an illustration of the use of the mobile phone holder attachment in an embodiment of the present invention.
Figure 10D:
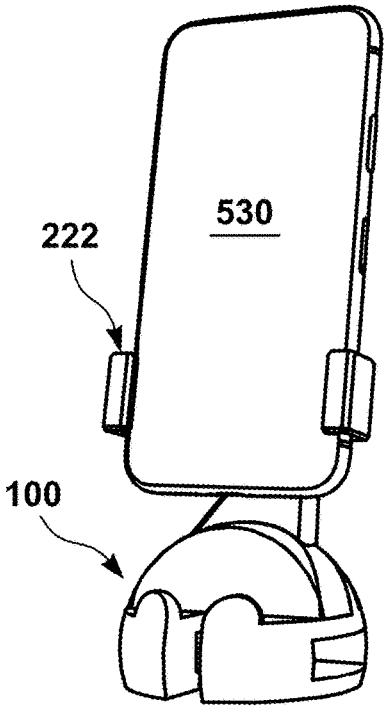
FIG. 10D is an illustration of the use of the mobile phone holder attachment in an embodiment of the present invention.
Figure 11A:
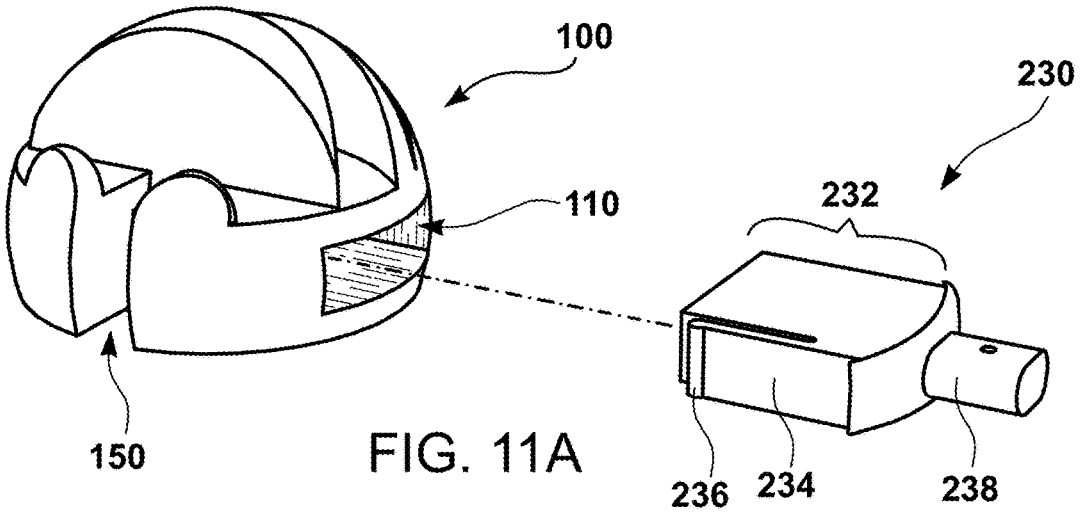
FIG. 11A is an illustration of the use of the mic stand attachment in an embodiment of the present invention.
Figure 11B:
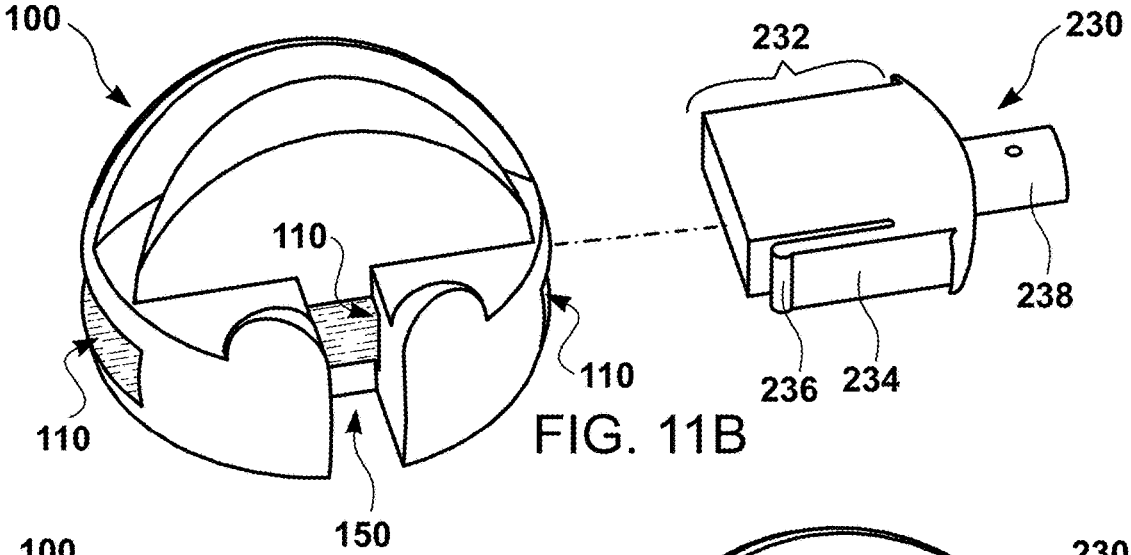
FIG. 11B is an illustration of the use of the mic stand attachment in an embodiment of the present invention.
Figure 11C:
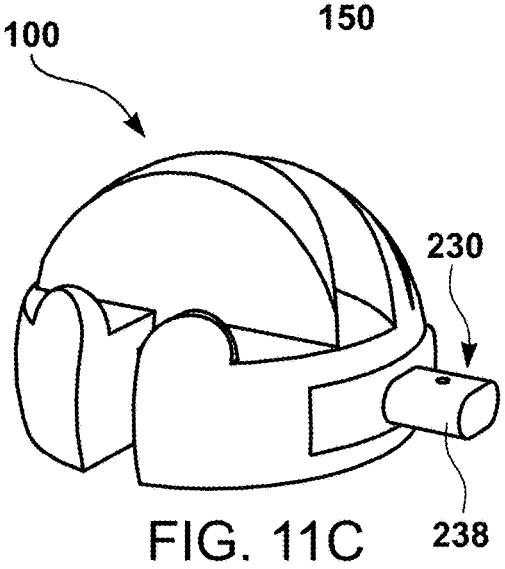
FIG. 11C is an illustration of the use of the mic stand attachment in an embodiment of the present invention.
Figure 11D:
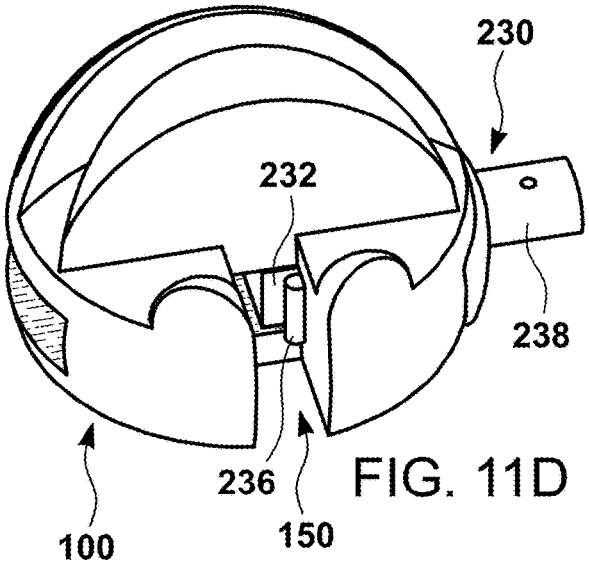
FIG. 11D is an illustration of the use of the mic stand attachment in an embodiment of the present invention.

Separate music stand 210 is used for applications where a user may need to hold an open book, or more than one sheet of paper, and may require more space to spread out the sheetmusic. FIGS. 9A and 9B show the back view of the separate music stand attached to the base. The separate music stand 210 also comprises a curved plug 216, a shelf 214, and a back panel 212. The shelf 214 and back panel 212 preferably nest into the phone holder on the base when the separate music stand is attached, as shown in the Figures. FIGS. 9C and 9D show the front view of the separate music stand, both empty and in use holding an open music book.

FIGS. 10A-10D show several views of the separate phone holder 220, including a view of it being used to hold a phone 530. As discussed above, the separate phone holder is used to hold a mobile phone or tablet if a more secure hold is needed than the one provided by the built-in phone holder of the base.

The base is preferably configured to be attached to a user's leg or other limb-however, it may also be attached to other objects near the user. FIGS. 11A-11D show a stand mount attachment 230 that could be used to mount the base on a music stand or microphone stand. In that embodiment, a plug 232 with a compression clip 234 is inserted into the strap hole 110. The terminal bump 236 on the compression clip 234 is used to release the plug 232 when it needs to be removed. The stand attachment point 238 is used to attach the clip and base to a microphone stand, and could be any shape that could perform that function.

The media holder may be used in multiple situations. It is most commonly used where a user is playing an instrument while seated, where the media holder is attached to the user's thigh in a way that the user can look down on the media while playing. In some cases, where the user's arm is relatively stationary while playing, the media holder may also be attached to the user's arm. If a user is sitting in a chair with arms, the media holder may be attached to the arm of the chair, or to the top of a guitar stand or other musical instrument stand, for example. As mentioned above, the media holder may be attached to a microphone stand with a stand mount attachment.

The advantages of this media holder are numerous. First of all, it is easy to use and holds either single sheets of music or music books at the correct angle without flexing. It is portable and can be taken anywhere—it easily fits into a musical instrument case. It is sturdy and does not break very easily, which is important for music festival situations where rough handling is a possibility. It is very easy to set up, as opposed to folding music stands. It takes no extra space in front of the user, meaning that it does not require a flat floor and does not block the user's line of sight.

Exemplary embodiments are described above. It is to be understood that the present invention is limited only by the appended claims.

The invention claimed is:

1. A device for displaying media, comprising:

a strap comprising a first end and a second end, wherein the first end and the second end comprise a buckle that can removably connect the first end to the second end;

a base attached to the strap, wherein the base comprises a top side and a bottom side;

a media holder integrated into the top side of the base, wherein the media holder is configured to hold at least one sheet of paper at an angle ranging between vertical and 45° off vertical;

wherein the media holder comprises a cutout in the top side of the base, wherein the cutout is a wide curved slot, wherein the wide curved slot is configured to flex any media placed into it in such a way that the media stays stiff while in the wide curved slot;

wherein the strap length is approximately equal to the circumference of a typical human thigh, wherein the angle of the media holder is configured so that a seated user can read the media on a sheet of paper in the media holder when the device is attached around the user's thigh.

2. The device of claim 1, wherein the wide curved slot is approximately 15 mm wide.

3. The device of claim 1, wherein the wide curved slot has a rectangular cross-section.

4. The device of claim 1, wherein the wide curved slot is a section of a circle with a radius of approximately 58 mm.

5. A device for displaying media, comprising:

a strap comprising a first end and a second end, wherein the first end and the second end comprise a buckle that can removably connect the first end to the second end;

a base attached to the strap, wherein the base comprises a top side and a bottom side;

a media holder integrated into the top side of the base, wherein the media holder is configured to hold at least one sheet of paper at an angle ranging between vertical and 45° off vertical;

wherein the media holder comprises a cutout in the top side of the base, wherein the cutout is a narrow curved slot, wherein the narrow curved slot is configured to flex any media placed into it in such a way that the media stays stiff while in the narrow curved slot;

wherein the strap length is approximately equal to the circumference of a typical human thigh, wherein the angle of the media holder is configured so that a seated user can read the media on a sheet of paper in the media holder when the device is attached around the user's thigh.

6. The device of claim 5, wherein the narrow curved slot has a triangular cross-section, with one of the vertices of the triangular cross-section at the bottom of the narrow curved slot, with a width at the top of the base of approximately 8 mm.

7. The device of claim 5, wherein the narrow curved slot is a section of a circle with a radius of approximately 75 mm.

8. The device of claim 1, further comprising a narrow curved slot, wherein the narrow curved slot has a triangular cross-section, with one of the vertices of the triangular cross-section at the bottom of the narrow curved slot, with a width at the top of the base of approximately ½".

9. The device of claim 1, wherein the bottom side of the base is flat.

10. The device of claim 1, wherein the base comprises a strap slot, wherein the strap slot is parallel to the plane of the bottom side of the base, wherein the strap slot is configured for the strap to pass through it.

11. The device of claim 1, further comprising:

a separate phone holder, comprising a phone holding end and a base engagement end, wherein the phone holding end comprises a clamp for holding a mobile phone, wherein the base engagement end comprises a curved plug with a rectangular cross-section that fits into the wide curved slot securely.

12. The device of claim 1, further comprising:

a separate music stand, comprising a music holding end and a base engagement end, wherein the music holding end comprises a platform for supporting sheetmusic, wherein the base engagement end comprises a curved plug with a rectangular cross-section that fits into the wide curved slot securely.

13. The device of claim 10, further comprising:

a separate plug, wherein the plug plugs into the strap slot, wherein the plug comprises a microphone stand attachment.

* * * * *